United States Patent [19]

Niskanen

[11] Patent Number: 4,594,052

[45] Date of Patent: Jun. 10, 1986

[54] CENTRIFUGAL PUMP FOR LIQUIDS CONTAINING SOLID MATERIAL

[75] Inventor: Toivo Niskanen, Hamina, Finland

[73] Assignee: A. Ahlstrom Osakeyhtio, Noormarkku, Finland

[21] Appl. No.: 541,331

[22] PCT Filed: Feb. 8, 1983

[86] PCT No.: PCT/FI83/00008

§ 371 Date: Sep. 20, 1983

§ 102(e) Date: Sep. 20, 1983

[87] PCT Pub. No.: WO83/02806

PCT Pub. Date: Aug. 18, 1983

[30] Foreign Application Priority Data

Feb. 8, 1982 [FI] Finland ..... 820388

[51] Int. Cl.[4] ..... F04D 29/42

[52] U.S. Cl. ..... 415/121 B; 415/213 A; 415/219 C; 416/185

[58] Field of Search ..... 415/121 B, 213 A, 206, 415/215, 208, 219 C; 416/185, 228, 188

[56] References Cited

U.S. PATENT DOCUMENTS

| | | | |
|---|---|---|---|
| 2,202,790 | 5/1940 | Forrest | 415/213 R |
| 3,644,056 | 2/1972 | Wiselius | 416/188 UX |
| 3,759,628 | 9/1973 | Kempf | 415/213 A |
| 4,093,401 | 6/1978 | Gravelle | 416/188 X |

FOREIGN PATENT DOCUMENTS

| | | | |
|---|---|---|---|
| 1057137 | 5/1959 | Fed. Rep. of Germany | 416/188 |
| 2818540 | 11/1978 | Fed. Rep. of Germany | 415/121 B |
| 1208163 | 2/1960 | France | 416/188 |
| 596270 | 7/1959 | Italy | 416/185 |

*Primary Examiner*—Abraham Hershkovitz
*Assistant Examiner*—Joseph M. Pitko
*Attorney, Agent, or Firm*—Bucknam and Archer

[57] ABSTRACT

A centrifugal pump for liquids containing solid material, the impeller of which has two or several vanes. In a bottom projection the leading edge (3) of the impeller (1) vane (2) is curved backwards in relation to the rotating direction of the impeller. The angle between the leading edge (3) and the outer edge (5) is obtuse in a meridian and a bottom projection. The outer end (10) of the leading edge of the vane is positioned behind a shoulder (9) provided with grooves (11), which cooperates with the vanes of the impeller. The form of the leading edge causes the fibres and the sticks to be conveyed towards the point of the vane where they are crushed by the combined effect of the groove and the vanes.

2 Claims, 3 Drawing Figures

CENTRIFUGAL PUMP FOR LIQUIDS CONTAINING SOLID MATERIAL

TECHNICAL FIELD

The present invention relates to a centrifugal pump for liquids containing solid material, comprising of a multi-vane impeller.

BACKGROUND ART

Pumps of this kind are used e.g. for transport of fibre suspensions and various sludges. Especially when pumping liquids containing longish solid particles, problems are caused by the particals sticking to the impeller vanes, to their leading edges in particular. This can result in clogging of the impeller and other disturbances in the operation of the pump.

DISCLOSURE OF INVENTION

It is an object of the present invention to eliminate the above mentioned disadvantages. This is realised by arranging the centrifugal force and the impact pressure component, which is parallel to the leading edge of the impeller vane and is brought about by the flow in the pump, to force the solid particles stuck to the leading edge towards the outer end of the leading edge. The outer end of the leading edge of the vane is disposed behind a flange provided with cutting edge grooves intended for detaching and shredding the fibres and sticks and thus preventing them from being accumulated and conveyed to the slot between the vane and the housing.

It is a characteristic feature of the centrifugal pump according to the invention that in a bottom projection the leading edge of the impeller vane is curved backwards in relation to the rotating direction of the impeller in such a way, that the inner edge of the vane runs ahead of the vane outer edge; that the angle between the leading edge and the outer edge is obtuse in a meridian and a bottom projection; that the outer end of the leading edge of the vane is positioned behind a shoulder; and that the shoulder and/or the inside wall of the housing is/are provided with a groove/grooves with a cutting edge which cooperates with the outer end of the leading edge of the vane.

The Finnish patent application No. 2169/79 discloses a single-vane centrifugal pump where the angle between the front edge and the outer edge of the vane is sharp in a meridian and a bottom projection, whereby the solid particles sticking to the front edge are conveyed towards the axis. The hub of the impeller forms a shoulderless extension of the front edge; thus the solid material is removed from the opposite side of the vane along the hub with the main flow. If this method was applied in multi-vane impellers the fibrous and stick-like formed particles could not be removed but they would be accumulated in the junction point of the vanes and would finally close the flow passages.

BRIEF DESCRIPTION OF THE DRAWINGS

The invention is described in detail below with reference to the accompanying drawing where.

DETAILED DESCRIPTION OF THE BEST MODE OF CARRYING OUT THE INVENTION

Figure 1:
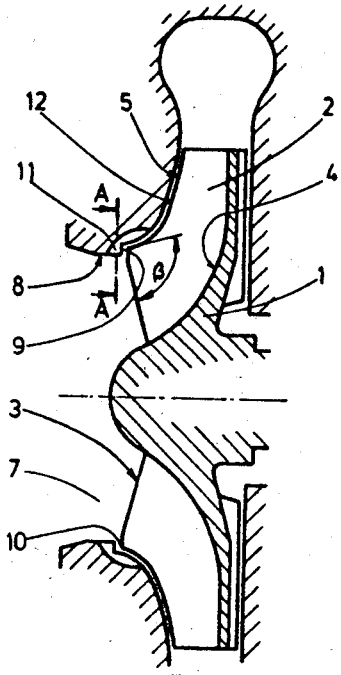
FIG. 1 is a sectional view of an impeller of a centrifugal pump according to the invention in a meridian projection.
Figure 2:
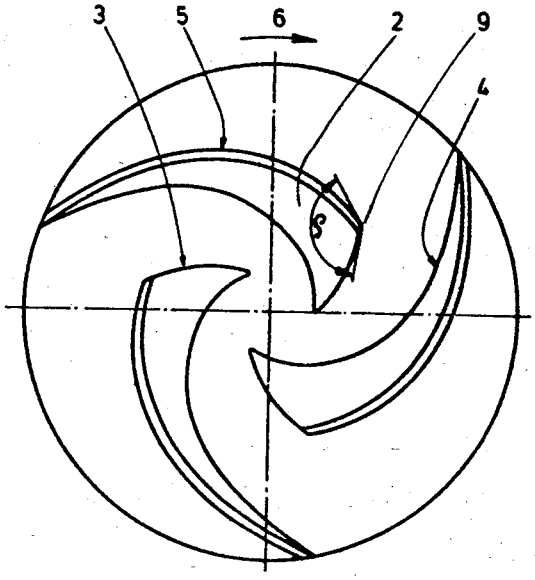
FIG. 2 is a sectional view in a bottom projection.
Figure 3:
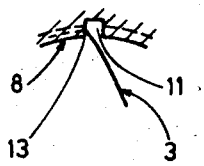
FIG. 3 is a section along line A—A in FIG. 1.

The centrifugal pump presented in the figures is provided with a half-open impeller 1 having three vanes 2, the leading edge of which is indicated by the numeral 3, the inner edge by the numeral 4 and the outer edge by the numeral 5. The angle between the leading edge and the outer edge is indicated in the meridian projection (FIG. 1) by $\beta$ and in the bottom projection by $\rho$. The arrow 6 indicates the rotating direction of the impeller.

The housing of the centrifugal pump constitutes an inlet opening 7 the inside wall 8 of which is provided with a shoulder 9 behind which outer end of the leading edge 10 of the vane is located. Near the outer end of the leading edge of the vane the housing is provided with a sharp-edged groove 11. There is a gap 12 between the outer edge of the vane and the inside wall of the housing.

The angles $\beta$ and $\rho$ between the leading edge and the outer edge of the vane are obtuse. In the bottom projection the leading edge of the vane is curved backwards in relation to the rotating direction of the impeller so that the inner edge 4 of the vane runs ahead of the outer edge 5.

Due to the form of the leading edge of the vane, the solid particles stuck to the leading edge are conveyed towards the outer end 10 of the leading edge of the vane of the vane, where they are crushed by the combined effect of the impeller vanes and the grooves 11 provided with cutting edges 13 and are conveyed with the main flow through the flow passages between the impeller vanes to the outlet opening of the pump. In this way the pump suction opening is prevented from being clogged and the solid material from being conveyed into the slot 12 between the vane and the housing.

The number of the slots is e.g. 1 and 3. Most preferably the number of the grooves and the number of the vanes are not divisible by the same number so that the solid material is not crushed in more than one point at a time.

The invention is not limited to the embodiment presented here as an example but several other modifications can be made of it without departing from the scope of the claims, e.g. propeller pumps and centrifugal pumps with an open impeller.

What I claim is:

1. A centrifugal pump for liquids containing solid material comprising a housing (7), a multi-vane impeller (1), each of the vanes (2) having an outer edge (5), an inner edge (4), and a leading edge (3), said leading edge being curved backwardly in a bottom projection, with respect to the direction of rotation of the impeller, whereby the inner edge (4) runs ahead of the outer edge during rotation, said leading edge and outer edge forming angles ($\beta$, $\rho$) which are obtuse in a meridian and a bottom projection respectively; said leading edge and inner edge forming an acute angle in the bottom projection, said leading edge having an outer end (10), said housing having an inner wall (8), said inner wall being provided with a shoulder (9) which forms a recess, said outer end (10) of the leading edge being positioned behind said shoulder (9) and within said recess, at least one of said shoulder and the inner wall of the housing being provided with at least one groove (11) having a cutting edge (13) which cooperates with the outer end of the leading edge of the vane for cutting said solid material.

2. A centrifugal pump according to claim 1, wherein a plurality of grooves is provided, the number of the grooves and the number of the vanes are not divisible by the same number.

* * * * *